US012337205B2

(12) United States Patent
Bartley

(10) Patent No.: US 12,337,205 B2
(45) Date of Patent: Jun. 24, 2025

(54) WEIGHT SLED APPARATUS AND METHOD

(71) Applicant: Marc Bartley, Columbia, SC (US)

(72) Inventor: Marc Bartley, Columbia, SC (US)

( * ) Notice: Subject to any disclaimer, the term of this patent is extended or adjusted under 35 U.S.C. 154(b) by 165 days.

(21) Appl. No.: 18/154,212

(22) Filed: Jan. 13, 2023

(65) Prior Publication Data

US 2023/0173322 A1 Jun. 8, 2023

Related U.S. Application Data

(63) Continuation-in-part of application No. 16/949,380, filed on Oct. 28, 2020, now abandoned, which is a continuation-in-part of application No. 15/929,429, filed on May 1, 2020, now Pat. No. 11,351,416.

(51) Int. Cl.
*A63B 21/06* (2006.01)
*A63B 21/00* (2006.01)

(52) U.S. Cl.
CPC ..... *A63B 21/0618* (2013.01); *A63B 21/151* (2013.01); *A63B 21/4035* (2015.10)

(58) Field of Classification Search
CPC . A63B 21/0004; A63B 21/06; A63B 21/4035; A63B 23/047; A63B 2209/00; A63B 2210/50; A61G 7/10
See application file for complete search history.

(56) References Cited

U.S. PATENT DOCUMENTS 4,046,393 A 9/1977 Vadnais
4,283,068 A 8/1981 Keyser
4,335,891 A * 6/1982 Alley ..... B62B 15/00 280/28.11
5,551,082 A * 9/1996 Stewart ..... A41D 13/0581 2/467
5,653,455 A 8/1997 Richards
D478,954 S 8/2003 Forrest
7,727,089 B2 6/2010 Gilman
7,972,224 B2 7/2011 Gilman
8,016,335 B2 * 9/2011 McKay ..... A62B 35/0006 294/152
8,936,253 B1 1/2015 Rizzi
8,986,172 B2 3/2015 Poole
9,232,699 B1 1/2016 Tosto
9,975,024 B1 5/2018 Potter
10,252,097 B1 * 4/2019 Raines ..... E02B 3/127
D847,920 S 5/2019 Lien
10,500,432 B2 12/2019 Bentley
10,711,921 B2 * 7/2020 Barger ..... H02G 3/32
2005/0023779 A1 2/2005 Kalvelage
2009/0051131 A1 2/2009 Warrington
2010/0048363 A1 2/2010 Gilberti et al.
(Continued)

*Primary Examiner* — Joshua Lee

(74) *Attorney, Agent, or Firm* — Southeast IP Group LLC; Thomas L. Moses

(57) ABSTRACT

A flexible weight sled includes a main body member made from a flexible material, such as a nylon webbing, canvas, or the like. The main body member includes a weight strap and a rear weight strap that is used to attach one or more weights to the main body member in a removable manner. Two pairs of upper body pulling straps are attached to the front portion of the main body member, and in a preferred embodiment, the upper body pulling straps include a pair of handles on a distal end thereof. The weight sled may be folded or rolled up for purposes of storage and/or transport.

8 Claims, 10 Drawing Sheets

(56) References Cited

U.S. PATENT DOCUMENTS

| | | | | |
|---|---|---|---|---|
| 2010/0243372 | A1 | 9/2010 | Wilkinson | |
| 2011/0224051 | A1 | 9/2011 | Larish | |
| 2013/0095984 | A1 | 4/2013 | Agate | |
| 2015/0061245 | A1* | 3/2015 | Rogier | B62B 15/00 280/19 |
| 2017/0136285 | A1 | 5/2017 | Chessen et al. | |
| 2017/0282008 | A1 | 10/2017 | Williams | |
| 2017/0326402 | A1* | 11/2017 | Sorin | A63B 21/4007 |
| 2018/0117396 | A1 | 5/2018 | Engelfried, Jr. | |

* cited by examiner

WEIGHT SLED APPARATUS AND METHOD

CROSS REFERENCE TO RELATED APPLICATIONS

The present application is a continuation-in-part of U.S. Application Ser. No. 16/949,380 entitled Weight Sled Apparatus and Method, filed on Oct. 28, 2020, which is a continuation-in-part of U.S. application Ser. No. 15/929,429 entitled Weight Sled Apparatus and Method, filed on May 1, 2020. All of the foregoing applications are hereby incorporated by reference in their entireties.

BACKGROUND OF THE INVENTION

The present invention relates generally to weight sleds used for physical fitness exercises and muscle building activities. More specifically, the present invention includes a flexible weight sled having means for attaching one or more weights thereto, along with a strap having a pair of handles attached for pulling the sled.

Weight sleds have been used as workout tools for many years by weightlifters, bodybuilders, sports athletes and the like. Typically, a sled includes a rigid frame that is used to carry and support one or more weights, and a upper body pulling strap or harness that is used to tow the sled along the ground behind a user. Some weight sleds are designed to be pushed, while others are designed to be pulled, and some may be used both ways.

The following documents show examples of weight sleds that have been developed over the years for these purposes, and each of the documents cited below are hereby incorporated herein by reference in their entireties:

UK Patent No. GB2507081 A Multi-Muscle Training Apparatus and Associated System

A muscle training system comprises sled arranged to receive weights, weights, and a means of attachment of the sled to a user, such as backpack harness. The sled may comprise a pair of runners mounted on a base, a mesh for containing components held in the base and a foldable ballast weight pole for fixing the weights in use. The system may compromise walking poles to aid the user pulling the sled. The amount of weight placed on the sled may be varied to provide different levels of resistance. The base may further compromise slots to accept resistance straps to enable to sled to be pulled or for exercise to be carried out when the user is stood on the sled, such as beaming. A door stopper or chair wedge may also be provided for attaching resistance straps. The apparatus may be used to recreate Nordic walking.

U.S. Pat. No. 7,727,089 Athletic Training Sled Apparatus

A weight sled apparatus useful for strength training and simulating the resistance of an opponent during a blocking event has a tubular construction forming a U-shaped member having a pair of parallel legs which serve as runners. A weight bearing member affixed to and extending between the pair of runners allows mounting of removable mount weights on a horn projecting therefrom. A crossbar extending between the runner ends presents a rearward facing surface at least 8 inches above the plane of the runners against which force may applied. An optional handlebar attachment presents a rearward facing surface against which force may applied in a range from 8 inches to 40 inches above the plane of the runners and normal thereto. The weight sled affords a trainee multiple force application surfaces near the center of gravity of the sled and at differing vertical heights, enabling a more realistic simulation of the resistance presented during a blocking event.

U.S. Pat. No. 7,972,224 Athletic Training Sled Apparatus

A weight sled apparatus useful for strength training and simulating the resistance of an opponent during a blocking event has a tubular construction forming a U-shaped member having a pair of parallel legs which serve as runners. A weight bearing member affixed to and extending between the pair of runners allows mounting of removable mount weights on a horn projecting therefrom. A crossbar extending between the runner ends presents a rearward facing surface at least 8 inches above the plane of the runners against which force may be applied. An optional handlebar attachment presents a rearward facing surface against which force may applied in a range from 8 inches to 40 inches above the plane of the runners and normal thereto. The weight sled affords a trainee multiple force application surfaces near the center of gravity of the sled and at differing vertical heights, enabling a more realistic simulation of the resistance presented during a blocking event.

U.S. Pat. No. 8,986,172 Exercise Sled

Embodiments are described for an exercise sled including an upper portion detachably coupled to a lower portion through telescoping leg assemblies located at the corners of the sled. The upper portion includes a flat jumping surface to facilitate jumping or step-up type exercises, and the lower portion includes a sled rail portion to facilitate sliding across a surface, and a weight platform for the addition of plate weights. A number of attachment hooks facilitate the use of cords or handles to perform resistance exercises using the sled as an exercise platform.

U.S. Pat. No. 9,975,024 Athletic Training Sled Providing Additional Methods of Resistance Training to Arm and Leg Movements While Running The present invention comprises a novel sled training device generally consisting of a sled with vertically oriented pole for attaching, a detachable cuboidal structure that attaches to the sled and holds pulley systems with stretch cords running through them and then to the ankles and wrists of the user. A rope or stretch cord attaches to the front of the sled and runs to an attachment point on a harness worn by the user when the apparatus is configured to be pulled by the user. The apparatus may be configured to be pushed by the user by means of an attachment that connects to the vertically oriented pole for attaching weights, and which has padded structures to be pushed by the subject's shoulders and/or forehead. The detachable cuboidal structure may be removed from the sled and attached to any stationary structure for use without the sled.

U.S. Pat. No. 10,500,432 Training Device

An exercise training device includes a sled portion extending along a first plane that is substantially parallel to a surface upon which the exercise training device is supported. The sled portion includes a first side that is in contact with the surface. A support structure, attached to the sled portion, includes a support surface that extends along a second plane that is substantially parallel to the first plane. The support surface supports an exercise weight. A handle portion is attached to one of the sled portion or the support structure, the handle portion allows a user to grip the exercise training device and move the exercise training device along the surface.

US Application No. 20100048363 Resistance Exercise Trainer and Related Speed Training Process The resistance exercise trainer includes an adjustable strap wearable by a user, a leash attached to the strap at a first end and a bag attached to a second end of the leash and configured for removable reception of at least one weight. When wearing the strap and pulling the bag and the weight with the leash, the weighted bag impedes user movement thereby providing resistance exercise training. As part of the resistance exercise training, the leash may be disconnected from the strap and used individually as a jump rope and the weight may be removed from the bag and used individually in strength training exercises. Together, the strap, the leash, the bag and the weight may be used in a speed training triangle.

US Application No. 20110224051 Indoor-Outdoor Exercise Sled Apparatus

An indoor-outdoor manually-propelled variable-resistance exercise sled for one or multiple users. The exercise sled features a rigid and durable weight-bearing platform. To protect indoor flooring surfaces, a removable, flexible, non-grip protective pad may be attached to the bottom of the exercise sled. When the protective pad is removed, the exercise sled can also be used on outdoor ground surfaces. The exercise sled includes dual attachment plates at opposite ends to provide multiple force application points to permit a variety of optional implements to be connected to the exercise sled. A removable handle assembly provides an additional force application surface. In combination, the various attachment points afford a multitude of pulling and pushing, lower-extremity and upper-extremity, functional exercises for one or simultaneously by multiple users.

US Application No. 20170136285 Strength and Exercise Apparatus

A mobile exercise apparatus performing physical exercises including lifting, pushing, and pulling is provided. The apparatus includes an exercise device having a planar elongated frame. The apparatus further includes a weight receiving portion configured to house one or more weights, a handle portion configured to enable a user to lift the exercise device while maintaining the position of the one or more weights, and a pulling portion configured to securing a pulling aid, wherein the elongated frame is bent at a curved portion at approximately a 90-degree angle.

US Application No. 20170282008 Athletic Training Equipment

An exercise apparatus may include a rectangular platform, first and second attachment points, first and second rails and friction reducing runners on the rails. The platform may have an upper face, a lower face, two long edges and two short edges. The first attachment point may be disposed along one of the long edges. The second attachment point may be disposed along the other of the long edges. The first rail may be attached to the lower face of the platform proximal to one of the short edges of the platform. The second rail may be attached to the lower face of the platform proximal to the other of the short edges of the platform. The first and second rails may be spaced apart to define a passageway beneath the apparatus, wherein the passageway is configured to allow the apparatus to pass over a standard sprinter's starting block without contacting any part of the starting block.

US Application No. 20180117396 Multi-Functional Exercise Apparatus

A durable and impact-resistant exercise apparatus that is portable, modular, stackable, and weight-adjustable to allow a user to perform a variety of isolated lower body, core, and upper body resistance training exercises as well as full-body strength training exercises to improve the fitness of a user. The exercise apparatus is configured both as a platform for supporting the user during a first plurality of exercises as well as a weighted body for being lifted or moved by the user during a second plurality of exercises.

WIPO Application No. WO2017196919 Training Sled Apparatus and Methods of Use

A training sled apparatus, comprising: a platform configured for dragging; and, at least one sleeve provided to the platform and configured for placing a training component therein.

It would be desirable, however, to provide a weight sled that is flexible, rather than rigid, so that it could be folded or rolled up for transport and storage. Additionally, it would be desirable to provide a weight sled that could accommodate one or more weights, as desired, which may be removably secured thereto, and which may be interchangeable with one another.

BRIEF SUMMARY OF THE INVENTION

In accordance with one aspect of the invention, a first embodiment of a flexible weight sled includes a main body member made from a flexible material, such as a nylon webbing, canvas, or the like. The main body member includes a weight strap that is used to attach one or more weights to the main body member in a removable manner. The main body member may also include a rear weight strap that is used to hold one or more weights to the main body member to prevent the rear portion of the weight from sliding off of the main body member. An upper body pulling strap extends from the front portion of the main body member, and in a preferred embodiment, the upper body pulling strap may include two pairs of handles on the distal ends thereof. One pair of handles is positioned lower on the upper body pulling strap than the other pair to accommodate users of different heights.

In a preferred embodiment, the weights are barbell style weights or bumper plates, which are typically circular weights defining a hole in a central portion thereof, although any suitable weights may be used. The weight may be placed on top of the main body member, and then the weight strap may be secured through the hole in the weight to strap the weight to the main body member. The rear weight strap may be secured by pulling the weight strap through the ring of the rear weight strap to secure the rear portion of the weight to the main body member.

The upper body pulling strap, in one embodiment, is preferably in the form of a Y-shaped configuration, where one end of the upper body pulling strap extends from a front portion of the main body member in a forward direction, and then splits into a pair of strap segments having two handles on the distal ends thereof.

In use, a user secures the weight or a plurality of weights to the main body member using the weight strap and the rear weight strap, and then grasps the handles of the upper body pulling strap to pull the weight sled. Exercises may include simply towing the weight sled behind the user while the user is facing forward, or may include having the user face the weight sled and pulling the weight sled toward himself or herself by pulling on the handles of the upper body pulling strap. Other types of exercises may be employed, as well.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
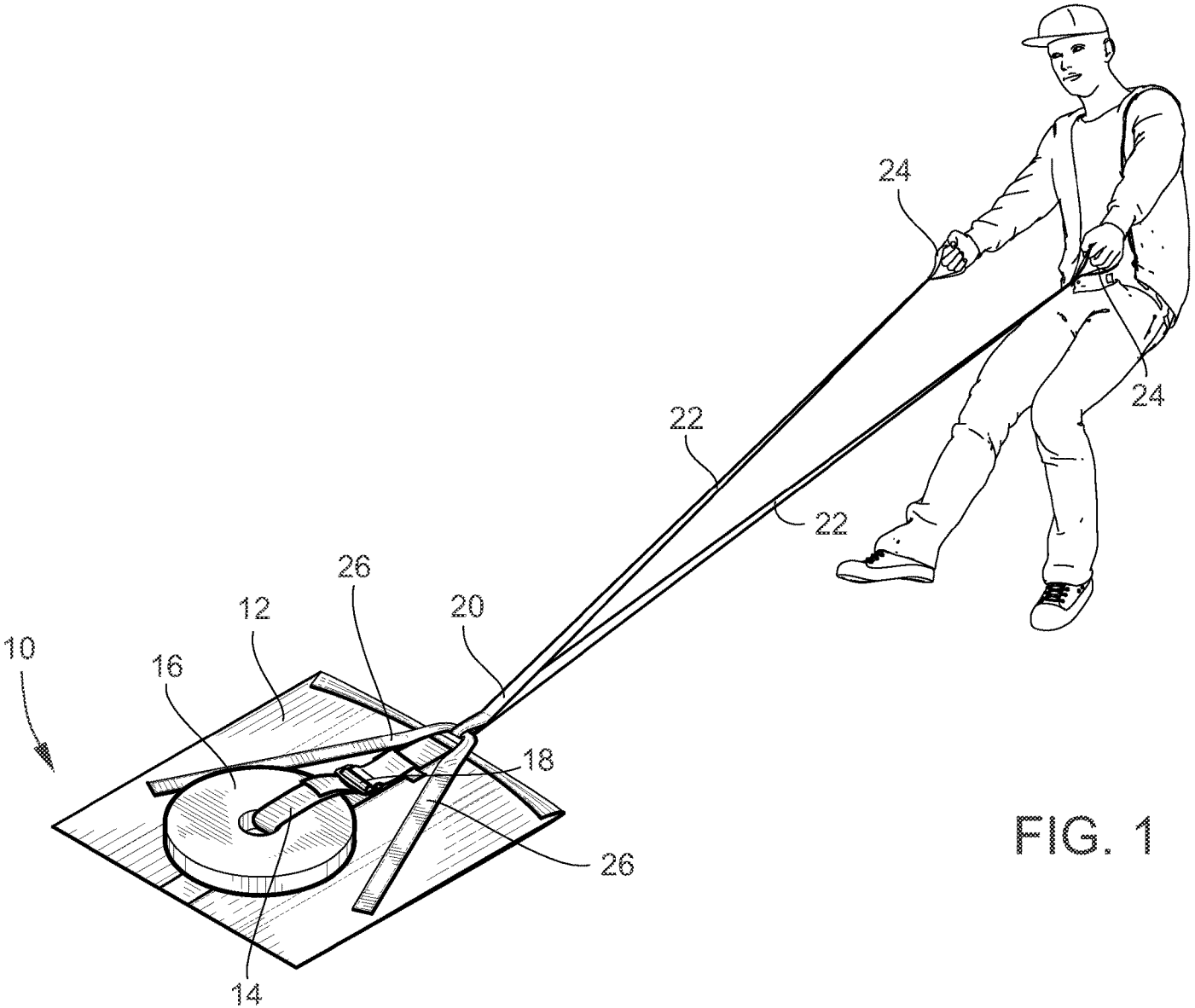
FIG. 1 is a perspective view of one embodiment of a weight sled apparatus in use by a user, wherein the weight sled includes a flexible main body member, a weight attached thereto by a weight strap, and a upper body pulling strap attached to the main body member.

The present invention includes, in a first embodiment, a weight sled for physical fitness exercises, as shown in FIGS. 1-10. The weight sled 10 includes a main body member 12 made from a flexible material or fabric, such as a heavy duty nylon webbing, canvas, or the like. The main body member 12 includes a weight strap 14 for removably securing a weight 16 on an upper surface of the main body member 12. The main body member 12 may also include reinforcing members 104 which secure the weight strap 14 to the main body member 12. The main body member 12 may also include a rear weight strap 100 for removably securing a weight 16 on a rear portion of the main body member 12. In a preferred embodiment, the front corners of the main body member 12 are raised and folded rearwardly, as shown.

Figure 2:
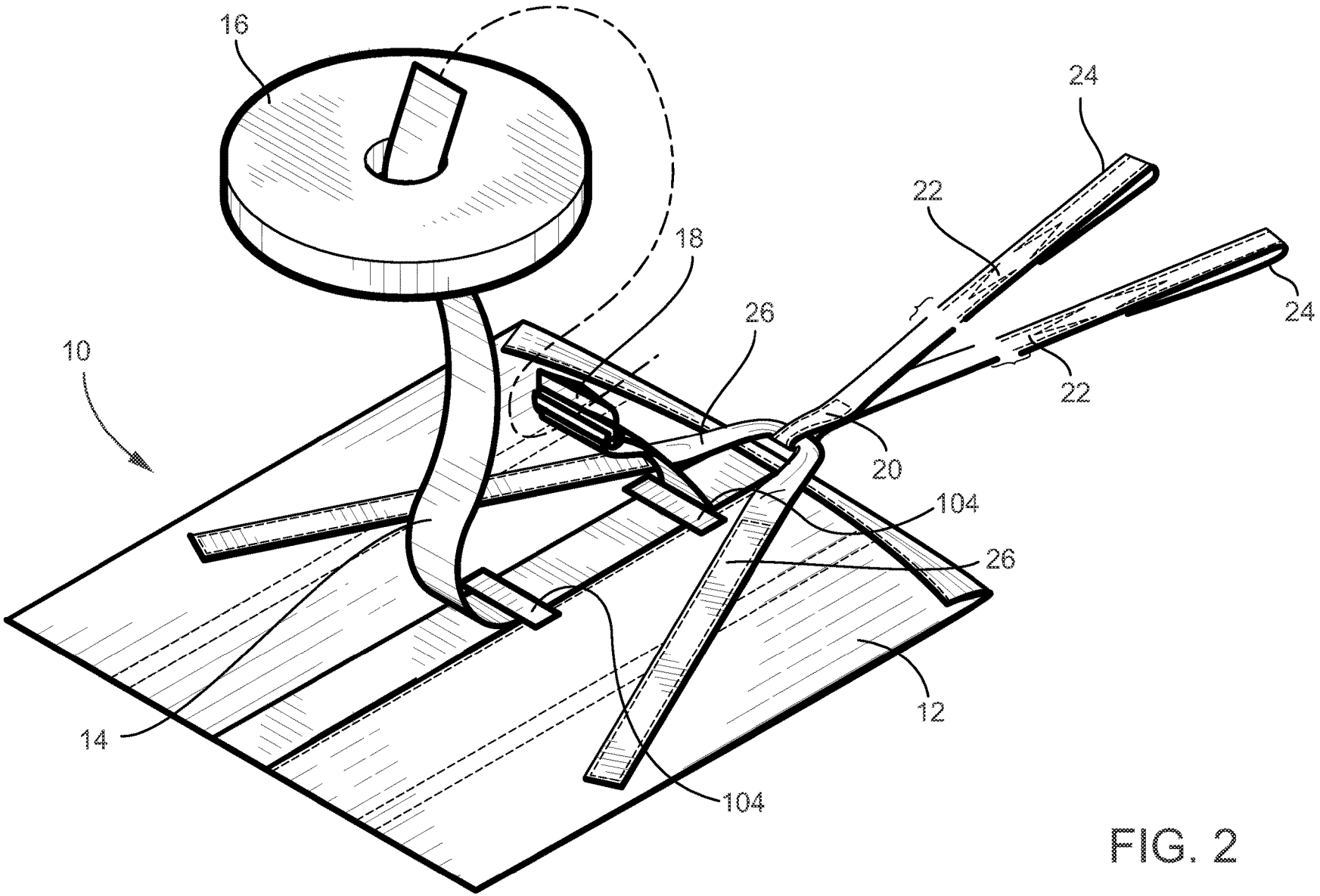
FIG. 2 is a perspective exploded view of one embodiment of a weight sled apparatus, showing the main body member and the weight strap being threaded through a central hole in a barbell style weight, with an indicator line showing that the free end of the weight strap is designed to be fed through a buckle for securing the weight to the main body member for use.
Figure 3:
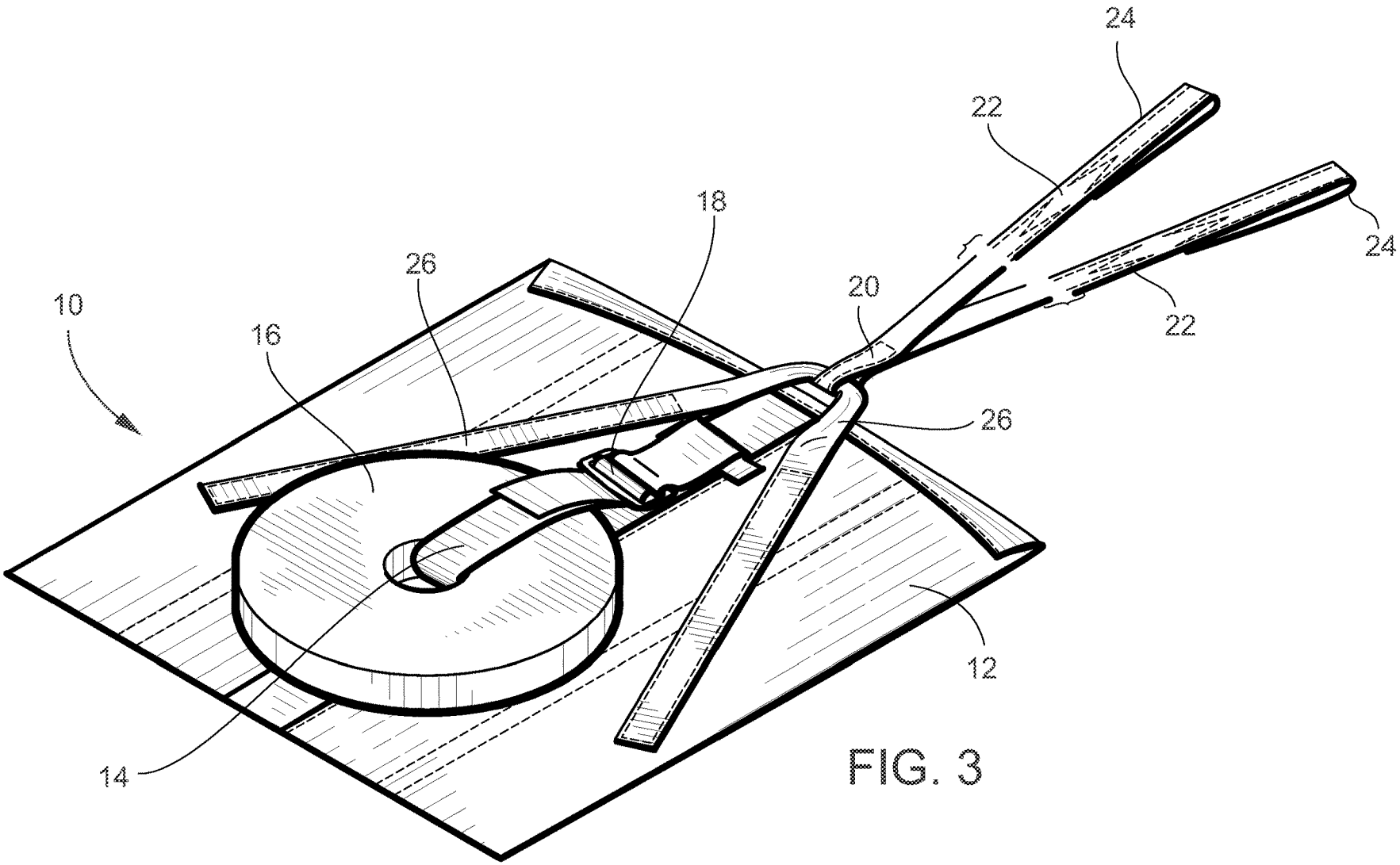
FIG. 3 is a perspective view of the embodiment of the weight sled apparatus shown in FIG. 2, wherein the weight is secured to the main body member by the weight strap/buckle assembly.
Figure 4:
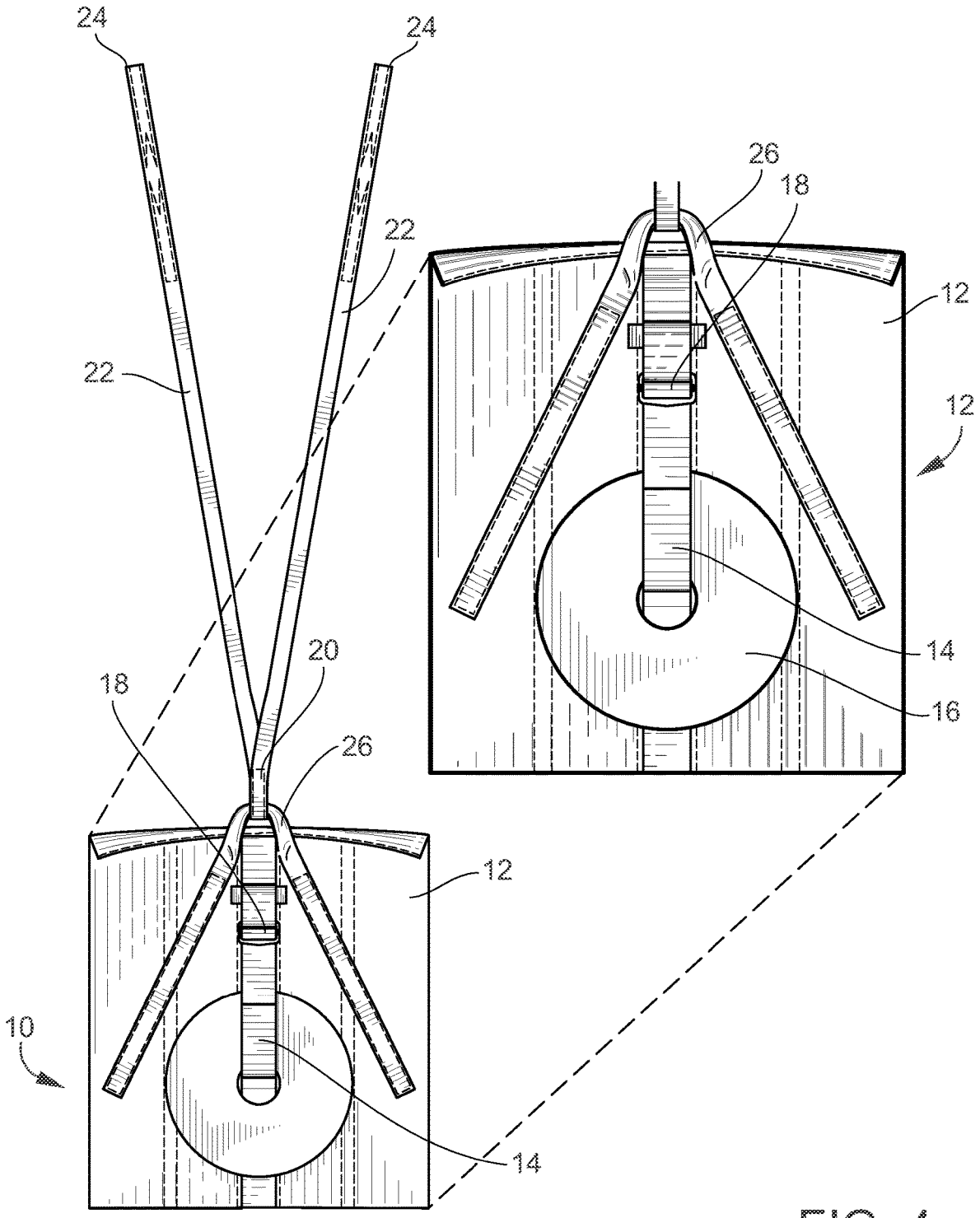
FIG. 4 is a top plan inset view of one embodiment of a weight sled apparatus in accordance with one aspect of the present invention.
Figure 8:
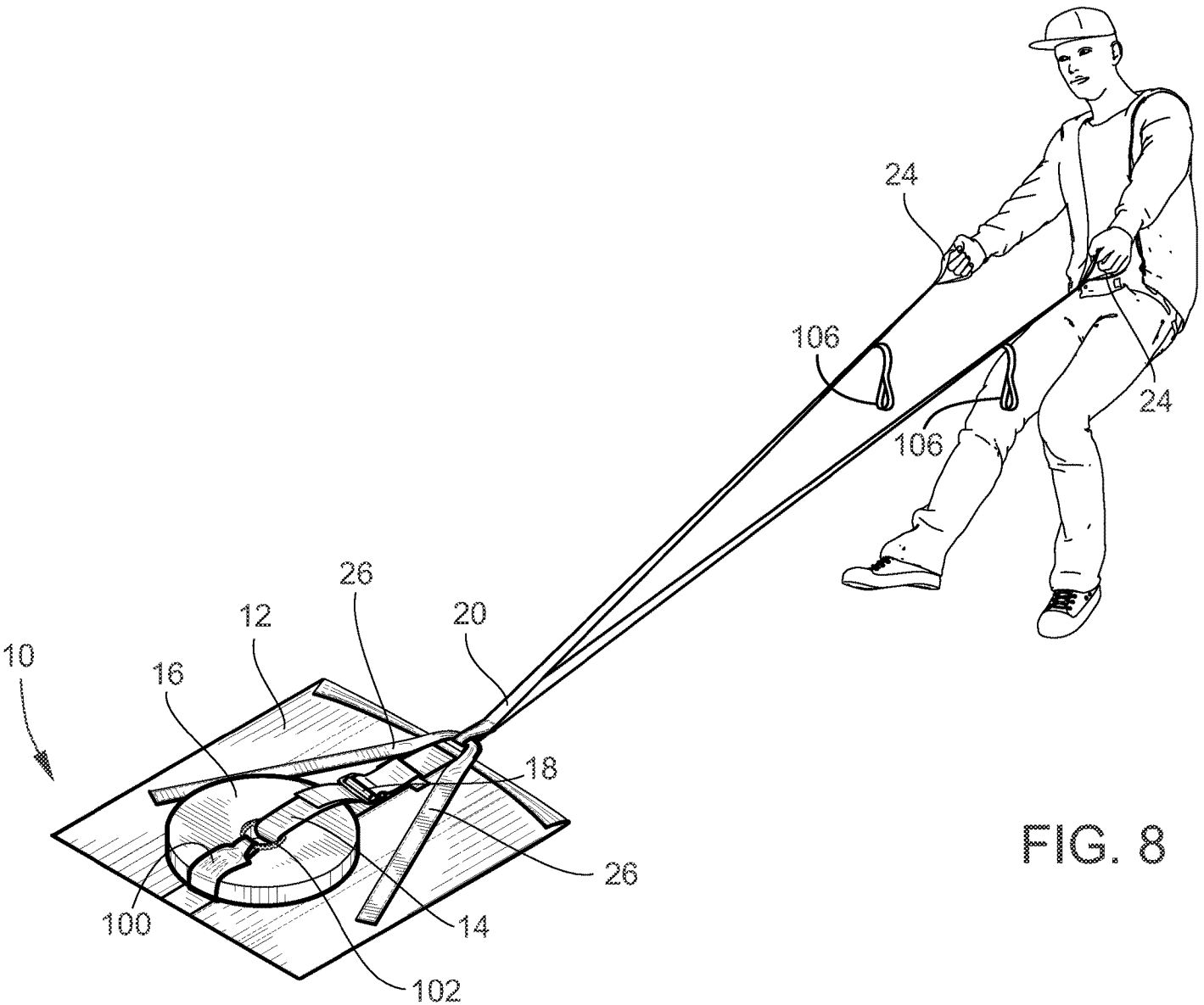
FIG. 8 is a perspective view of one embodiment of a weight sled apparatus in use by a user, wherein the weight sled includes a flexible main body member, a weight attached thereto by a weight strap and a rear weight strap, and an upper body pulling strap attached to the main body member.
Figure 9:
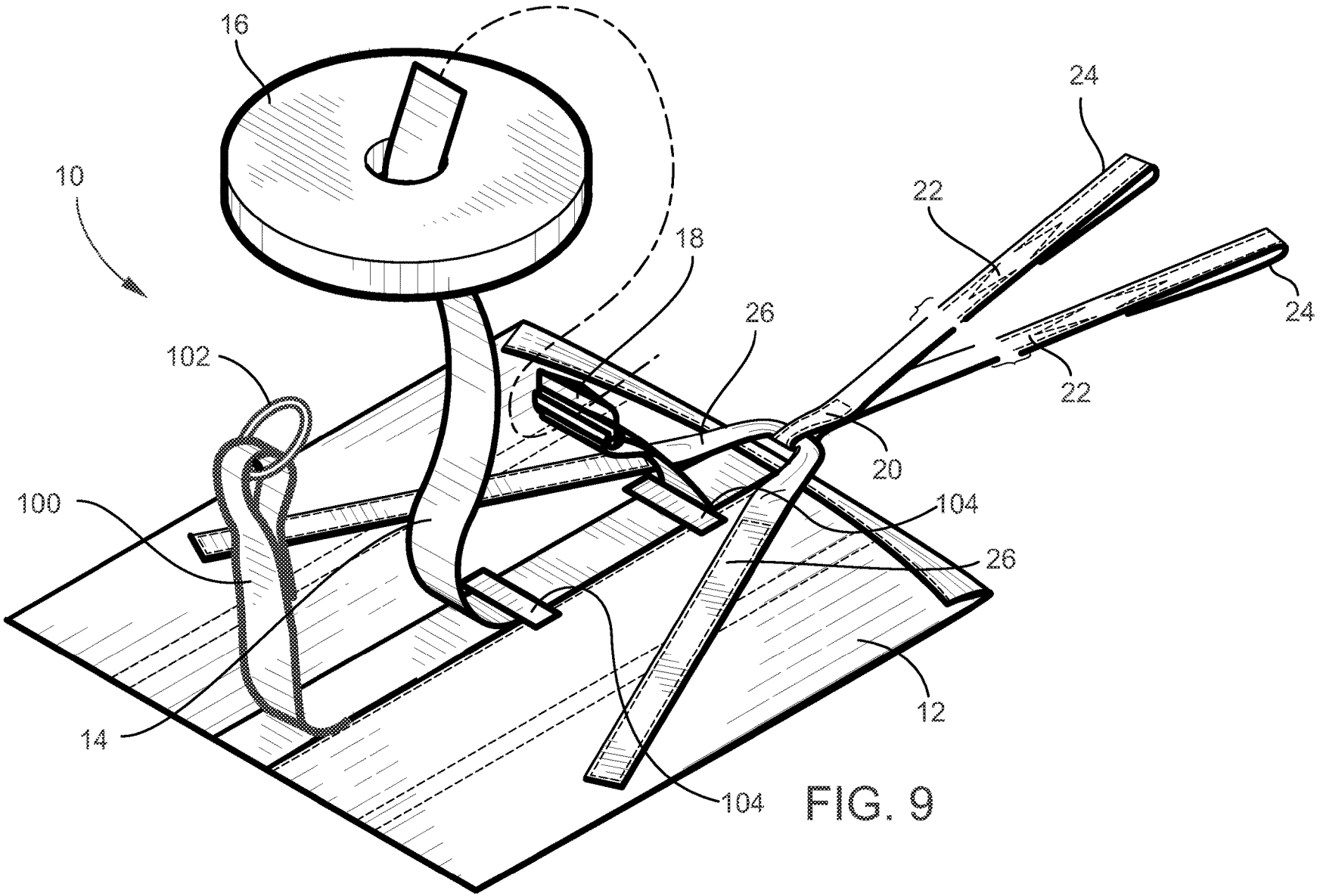
FIG. 9 is a perspective exploded view of one embodiment of a weight sled apparatus, showing the main body member and the weight strap being threaded through a central hole in a barbell style weight, with an indicator line showing that the free end of the weight strap is designed to be fed through a buckle for securing the weight to the main body member for use.
Figure 10:
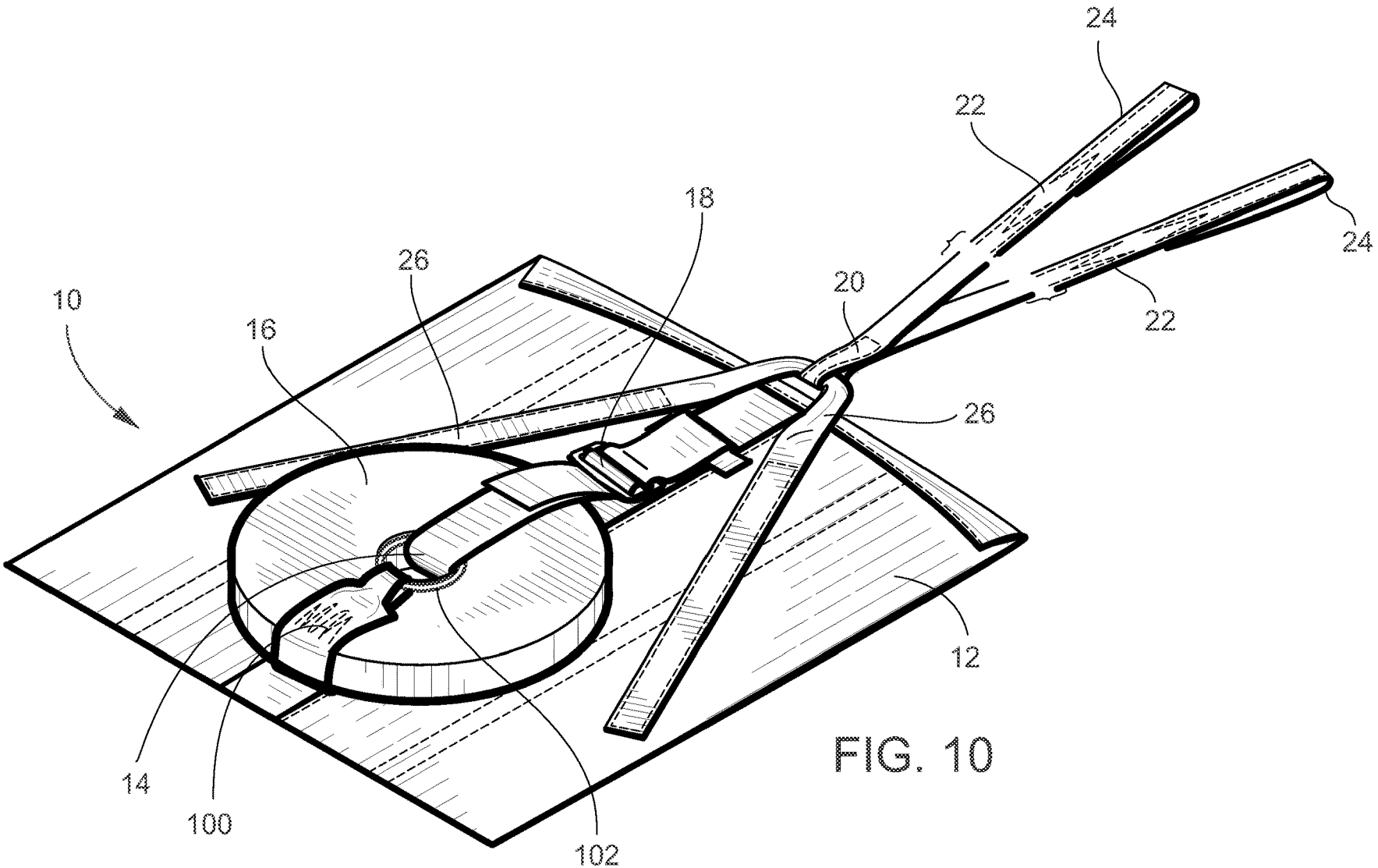
FIG. 10 is a perspective view of the embodiment of the weight sled apparatus shown in FIG. 9, wherein the weight is secured to the main body member by the weight strap/buckle assembly and the rear weight strap/ring assembly.

The weight strap 14 is preferably configured to extend through a hole in the center of the weight 16, and includes a buckle 18 that allows the weight strap 14 to be tightened and secured about the weight 16, so that the weight is held in place on the upper surface of the main body member 12, as shown in FIGS. 2 and 3. The rear weight strap 100 is preferably configured such that the weight strap 14 extends through a ring 102 on the proximate end of the rear weight strap 100 allowing the rear weight strap 100 to be tightened and secured about the weight 16, holding the weight in place on the lower surface of the main body member 12, as shown in FIGS. 8 and 10. Other types of weight straps or securing means may be used, such as a snap-fit fastener or the like.

The weights 16 are preferably barbell style weights or bumper plates, which are typically circular weights defining a hole in a central portion thereof, although any suitable weights may be used. Different sized weights 16 may be used, either together or interchangeably, and it should be understood that multiple weights 16 may be attached to the main body member by using the weight strap 14 and rear weight strap 100, as desired.

The upper body pulling strap 20 is preferably in the form of a Y-shaped configuration, as shown, where one end of the upper body pulling strap 20 is attached to a front portion of the main body member 12 and extends in a forward direction, and then splits into a pair of strap segments 22, each having a handle 24, as shown in FIGS. 1-7. The strap segments 22 may also include a second set of handles 106, each of which is positioned lower on the strap segments 22 than handles 24, as shown in FIG. 8, to accommodate users of different heights.

In one embodiment, a V-shaped support strap 26 may be attached to the top of the main body member 12, so that the apex of the V is centrally positioned on a front portion of the main body member 12, and the upper body pulling strap 20 is affixed or connected to the V-shaped support strap 26 at the apex thereof, as best shown in FIGS. 1-4. The V-shaped support strap 26 is preferably sewn or otherwise attached or adhered to the main body member 12 along its length on both sides of the V, in order to distribute the towing force across more surface area of the main body member 12, as shown. Alternatively, a harness may be used instead of the handles 24, so that the harness may be attached to the user, and the upper body pulling strap 20 attached to the harness for towing the weight sled 10.

In use, a user secures the weight 16 or a plurality of weights 16 to the main body member 42 using the weight strap 14 and buckle 18 and the rear weight strap 400 and ring 402, and then grasps the handles 24 of the upper body pulling strap 20 to pull the weight sled 10, as shown in FIGS. 1 and 8. Exercises may include simply towing the weight sled 10 behind the user while the user is facing forward, or may include having the user face the weight sled and pulling the weight sled toward himself or herself by pulling on the handles 24 of the upper body pulling strap 20. Other types of exercises may be employed, as well.

When the weight sled 10 is not in use, the weight 16 may be removed from the main body member 12, and the weight sled 10 and upper body pulling strap 20 may be folded or rolled up for storage and transportation purposes. It is contemplated that the weight sled 10 and the weights 16 may be transported and/or stored in a duffel bag, sport bag, or the like.

Figure 5:
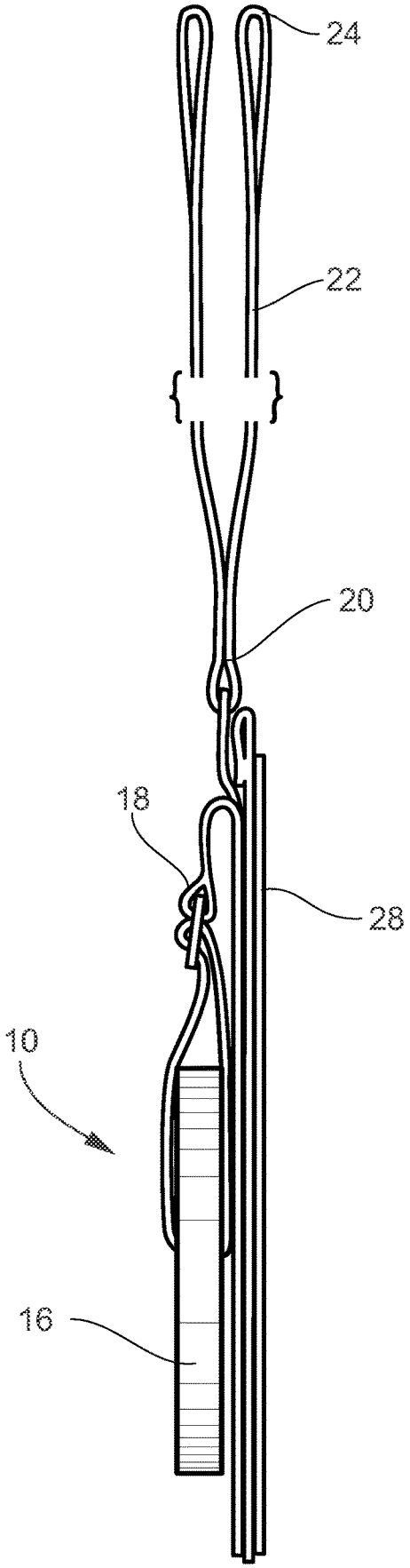
FIG. 5 is a side view of one embodiment of a weight sled apparatus in accordance with one aspect of the present invention.
Figure 6:
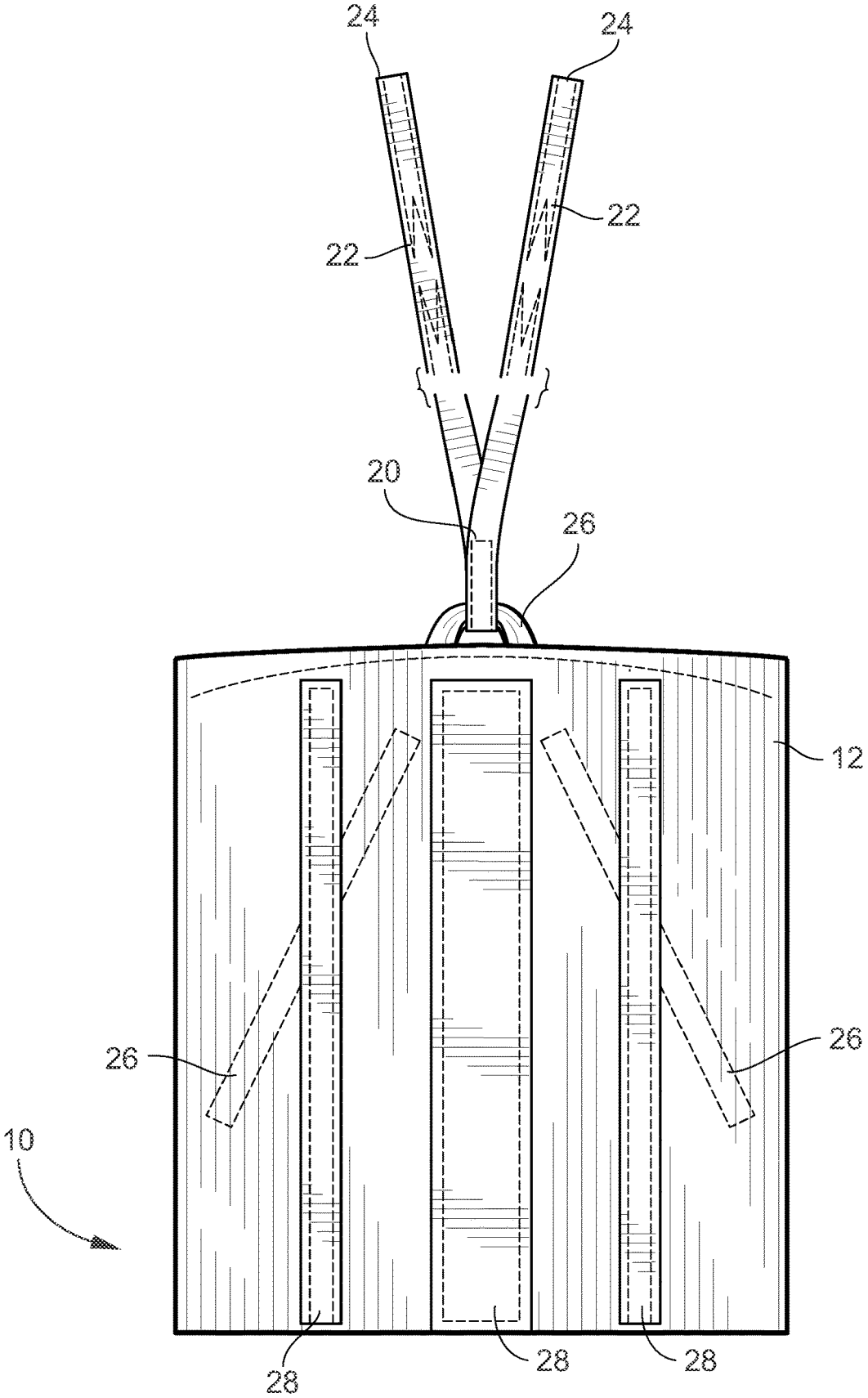
FIG. 6 is a bottom view of one embodiment of a weight sled apparatus in accordance with one aspect of the present invention.
Figure 7:
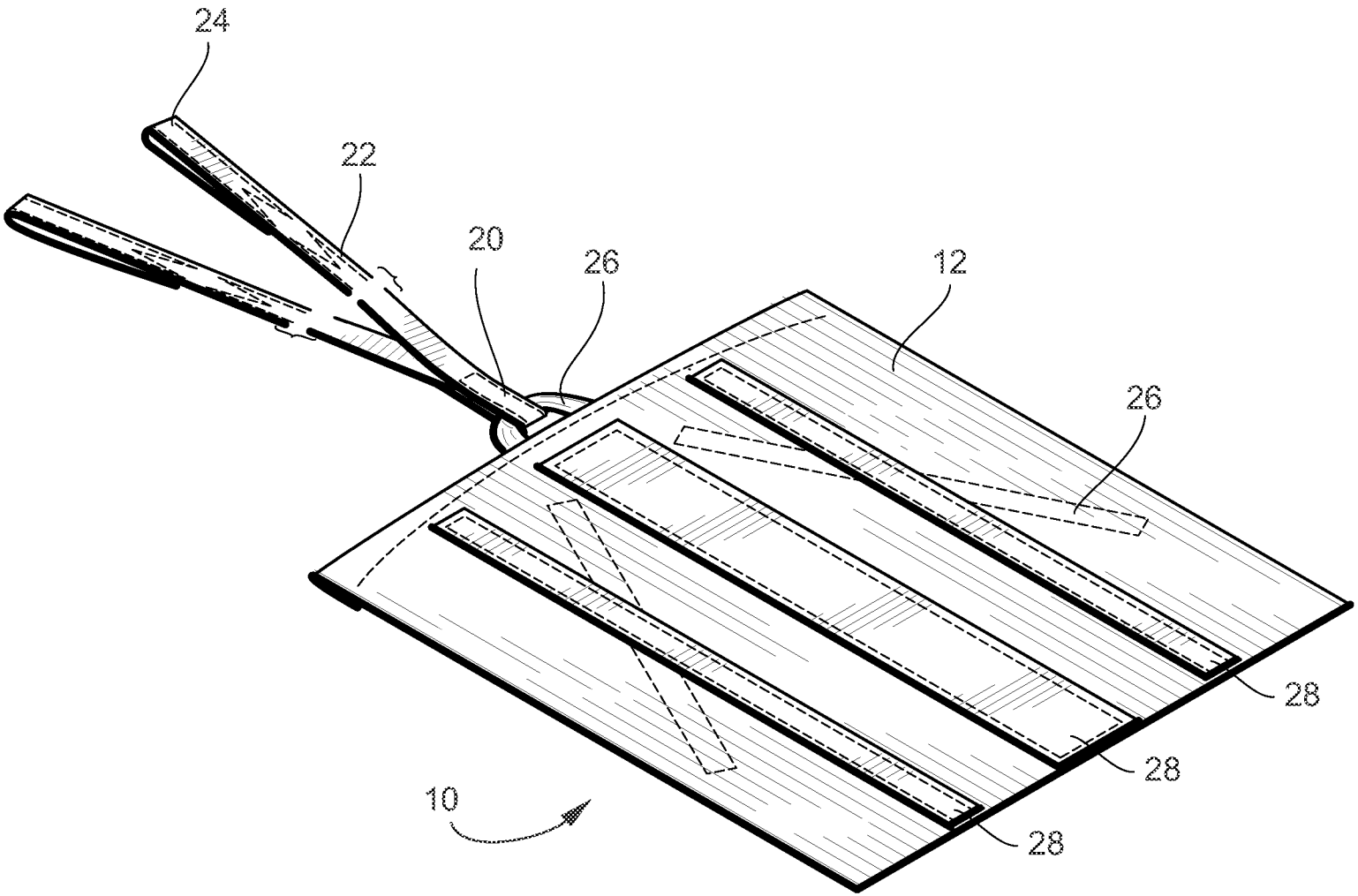
FIG. 7 is a perspective view of a bottom side of a weight sled apparatus in accordance with one aspect of the present invention.

Additionally, the main body member 12 may optionally include support strips 28 that are sewn or otherwise attached to an underside thereof, as shown in FIGS. 5-7, and these support strips 28 serve the purposes of acting as skid pads and providing additional structural support to the main body member 12. The main body member 12 may comprise a single layer of material, or multiple layers, as desired. The weight sled 10 may also be treated or coated in order to provide additional abrasion resistance and to prevent degradation of the material due to abrasion, wear and tear and general punishment that the weight sled 10 endures during use across rough ground or surfaces. For example, a coating that is currently marketed as NanoSphere® by Murdock Webbing, may be employed to provide such anti-abrasion and water-resistance to the weight sled 10, upper body pulling strap 20, weight strap 14, and rear weight strap 100.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A weight sled comprising:

a main body member made from a flexible material that may be folded or rolled, said main body member having a front end and a rear end disposed on opposite ends in a longitudinal direction;

a weight strap attached to said main body member for removably securing a weight to an upper surface of said main body member;

a rear weight strap attached to said main body member for removably securing a weight to a lower surface of said main body member, wherein said rear weight strap is attached adjacent said rear end of said main body member, and wherein said rear weight strap is oriented in said longitudinal direction;

a support strap attached to said main body member on said front end thereof, said support strap forming a loop on a front portion of said main body member; and an upper body pulling strap attached to said loop on said support strap.

2. The weight sled set forth in claim 1, as wherein said weight strap is adjustable.

3. The weight sled set forth in claim 1, wherein said support strap is configured into a V shape.

4. The weight sled set forth in claim 1, wherein said upper body pulling strap is configured into a Y shape, and includes a pair of handles on distal ends thereof.

5. The weight sled set forth in claim 1, further including a second pair of handles positioned lower on the strap segments than the first pair of handles to accommodate different heights of users.

6. The weight sled set forth in claim 1, further including a weight that is removably secured to said main body member by said weight strap.

7. The weight sled set forth in claim 1, wherein said main body member is made from a nylon webbing.

8. The weight sled set forth in claim 1, wherein said main body member includes an anti-abrasion coating.

* * * * *